US005403212A

United States Patent [19]

Aimasso

[11] Patent Number: 5,403,212

[45] Date of Patent: Apr. 4, 1995

[54] ELECTRIC CONNECTOR

[76] Inventor: Mario Aimasso, Corso De Gasperi, 18, 10098 Rivoli, Italy

[21] Appl. No.: 99,412

[22] Filed: Jul. 30, 1993

[30] Foreign Application Priority Data

Jul. 31, 1992 [IT] Italy ..... TO92A0663

[51] Int. Cl.[6] ..... H01R 13/514

[52] U.S. Cl. ..... 439/752; 439/598

[58] Field of Search ..... 439/595, 598, 752

[56] References Cited

U.S. PATENT DOCUMENTS 4,787,864 11/1988 Hunt et al. ..... 439/595
5,120,269 6/1992 Endo et al. ..... 439/752

FOREIGN PATENT DOCUMENTS 0058237 8/1982 European Pat. Off. .
0164211 12/1985 European Pat. Off. .
0510583 10/1992 European Pat. Off. .

OTHER PUBLICATIONS

EPO Search Report EP 93 11 2298 (Nov. 1993).

*Primary Examiner*—Eugene F. Desmond

[57] ABSTRACT

An electric connector comprising an outer casing; a terminal block housed inside the casing and having a number of through cavities arranged in two parallel rows adjacent to the lateral walls of the terminal block; and a number of electric terminals housed inside respective cavities and retained therein by respective primary retaining means and by secondary retaining means consisting of a pair of movable elements integral with the lateral walls of the terminal block, connected to the terminal block by an elastic hinge, and having a number of teeth cooperating, in an assembly position, with respective electric terminals; snap-on means being provided for mutually engaging the lateral walls of the terminal block and the movable elements for maintaining the movable elements stably in the aforementioned assembly position.

11 Claims, 2 Drawing Sheets

1

48
68
61
61
47
51
64
63
63
64
65
65
45
5
5
16
2
49
16
18
18
18'
3
21
17
21
49
21a
17
21a
29
19
19
26
26
22
60
38
20
38
24
27
20
25
60
25
24
28
30
31
70
4
4
71
41
41
6
6
12
46
11

ELECTRIC CONNECTOR

BACKGROUND OF THE INVENTION

The present invention relates to an electric connector, particularly, though not exclusively, for connecting an electronic control system to the electric system of a motor vehicle.

Known electric connectors for connecting vehicle electronic control and electric systems substantially comprise a terminal block made of insulating material and having a number of cavities housing respective terminals; and an outer casing housing the terminal block and having retaining means for snap-on assembly to the terminal board of the electronic system. The cavities in the terminal block are normally arranged in two side by side rows, and internally define primary snap-on retaining means for the terminals. Secondary means are also conveniently provided for retaining the terminals inside the respective cavities.

According to a known embodiment in Italian Patent Application n. TOU91000096 filed on 24 Apr., 1991, said secondary retaining means consist of a pair of elements secured integrally to the opposite lateral walls of the block and movable between a pressed position, wherein they are detached from the block, and an assembly position, wherein they engage respective seats formed in said lateral walls. On the side facing inwards of the terminal block, the elements present a number of teeth, which penetrate partially inside the cavities and cooperate with respective mating portions on the terminals, for achieving the secondary terminal retaining function mentioned above.

The secondary retaining elements present respective longitudinal outer projections designed to engage respective guide grooves, formed on the inside of the lateral walls of the outer casing, when the terminal block is fitted inside the casing.

A major drawback of known connectors of the type briefly described above is that the assembly position of the secondary terminal retaining elements depends exclusively on the elements engaging the guide grooves. As such, the retaining elements must be kept in the assembly position prior to inserting the terminal block inside the casing, which obviously complicates the assembly procedure and tooling. Moreover, the elements must necessarily be inserted longitudinally for them to slide inside the respective grooves, so that an opening must be provided in one end of the outer casing, which is not always desirable, particularly in applications requiring airtight sealing.

SUMMARY OF THE INVENTION

It is an object of the present invention to provide a connector of the aforementioned type, designed to overcome the drawbacks typically associated with the aforementioned known types.

According to the present invention, there is provided an electric connector comprising:

an outer casing;

a terminal block housed inside said casing and having a number of through cavities arranged in at least one row parallel and adjacent to a lateral wall of the terminal block;

a number of electric terminals housed inside respective said cavities and retained therein by respective primary retaining means; and secondary means for retaining said terminals inside said cavities;

said secondary means for retaining said terminals comprising at least one movable element integrally connected by hinge means to a lateral wall of said terminal block and having a number of first teeth cooperating with respective said terminals in an assembly position wherein said movable element is adjacent to said lateral wall;

characterized by the fact that it comprises means for mutually engaging said lateral wall of said terminal block and said movable element, and which provide for maintaining said movable element stably in said assembly position.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
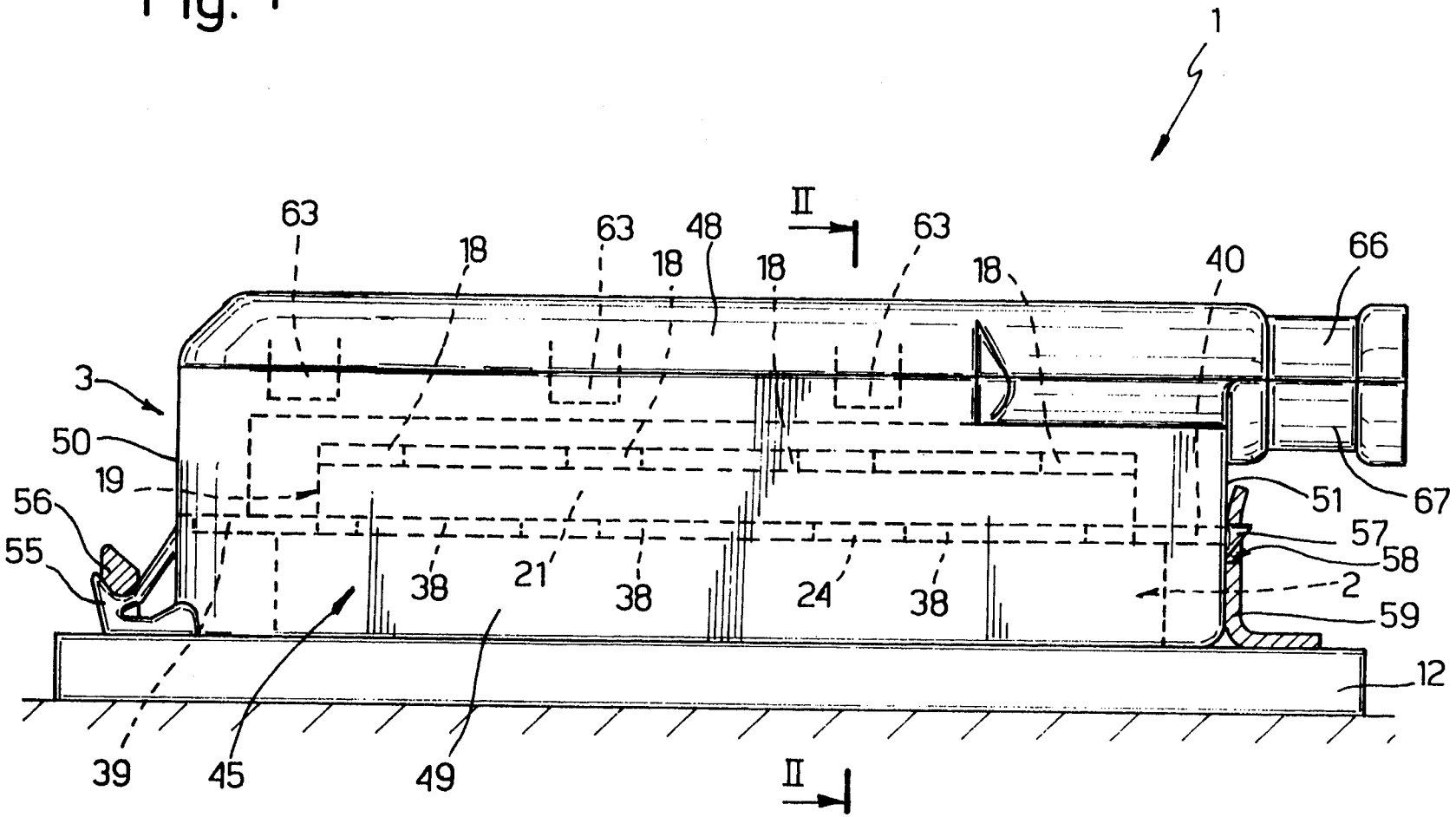
FIG. 1 shows a side view of an electric connector in accordance with the teachings of the present invention.

FIG. 1 shows a multiway connector 1, particularly for connecting the electronic control and electric systems of a motor vehicle.

Connector 1 substantially consists of a terminal block 2 and an outer casing 3 housing block 2.

Terminal block 2 is substantially in the form of an elongated parallelepiped, is defined by a pair of lateral walls 4, and defines a number of through cavities 5 (FIG. 2) arranged in two rows parallel and adjacent to lateral walls 4, and extending parallel to the shorter dimension of walls 4.

Lateral walls 4 define a number of flexible teeth 6 extending inside respective cavities 5 and constituting primary retaining means for respective known electric terminals 11 (only one shown in FIG. 1) cooperating in use with corresponding electric terminals (not shown) on terminal board 12 of the electronic control system (shown only partially).

Each lateral wall 4 of terminal block 2 presents a projecting longitudinal edge 16, and a number of through openings 17 communicating with respective cavities 5. By means of a number of curved elastic elements 18 defining an elastic hinge 18', edge 16 of each wall 4 is fitted integrally with a respective movable element 19 having a substantially L-shaped cross section.

Each element 19 comprises a number of teeth 20 (FIG. 2), which penetrate inside respective cavities 5 through openings 17, and cooperate with a mating portion 22 of electric terminals 11 for preventing withdrawal of the terminals as described in more detail later on.

More specifically, each element 19 comprises a longitudinal, elongated rectangular wall 21, one longer side of which is connected to respective wall 4 by means of elastic elements 18; and a wall 24 extending perpendicularly outwards of block 2 from the opposite side of wall 21 in relation to elements 18. Wall 21 presents a number of projecting transverse ribs **21*a* at each opening 17; and teeth 20 extend from each rib 21*a* close to the edge joining walls 21 and 24 and in the opposite direction to wall 24**.

Figure 2:
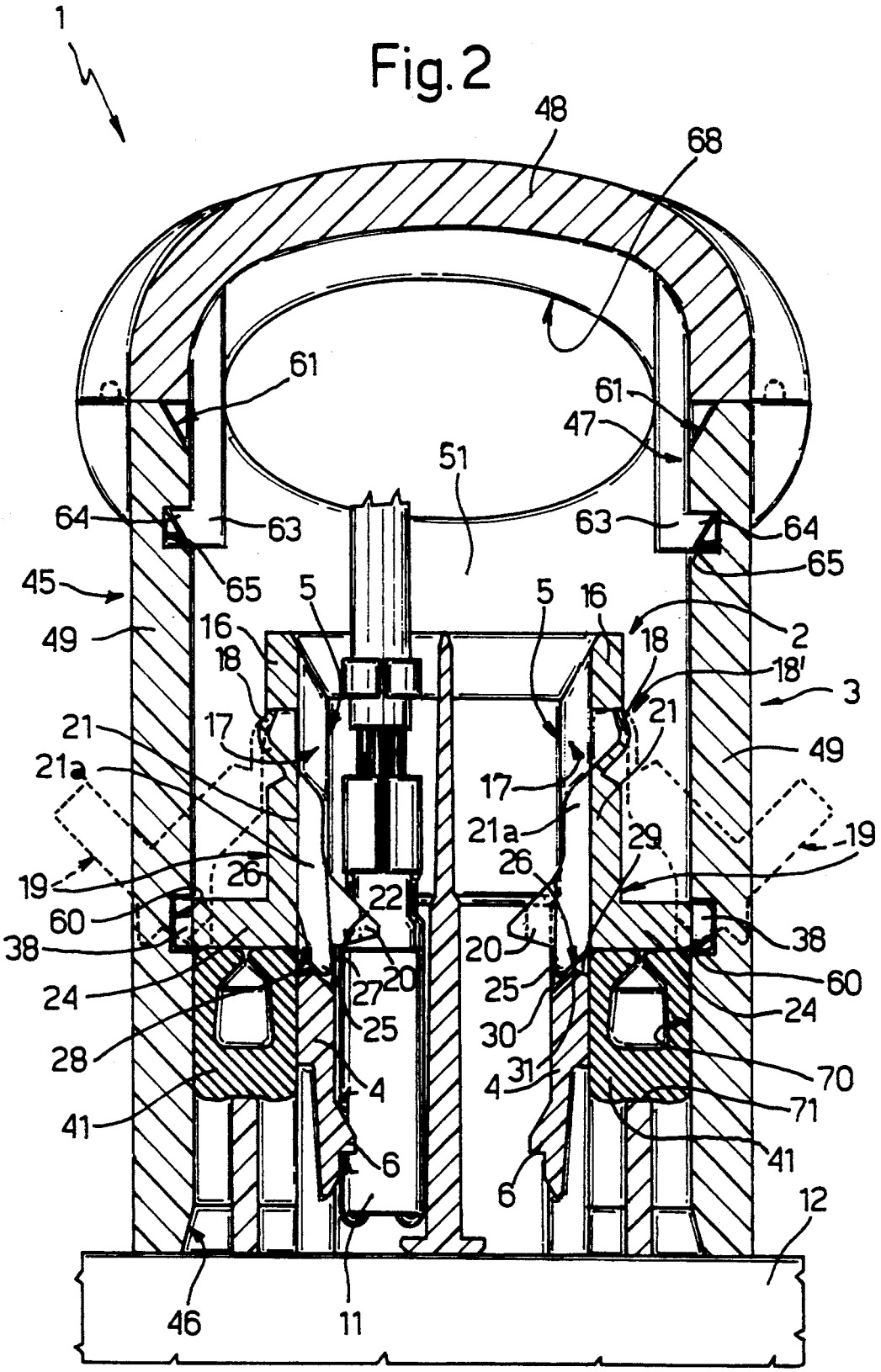
FIG. 2 shows a larger-scale section along line II—II in FIG. 1.

In FIG. 2, terminal block 2 is shown in the pressed position by the dotted line, and in the assembly position, following assembly of the connector, by the continuous line.

In the pressed position, walls 21 of elements 19 slope outwards of block 2 by an angle of substantially 45°.

In the assembly position, elements 19 are rotated about elastic hinges 18′ so that walls 21 are adjacent to walls 4, and walls 24 extend laterally and perpendicularly to walls 4.

According to the present invention, elements 19 also present a number of substantially triangular-section teeth 25 extending from the end of ribs 21*a* adjacent to wall 24, and in a direction substantially perpendicular to wall 24 and sloping slightly inwards of block 2. Teeth 25 are designed to cooperate with a respective mating surface 26 formed on the side of each opening 17 opposite elastic hinge 18′. More specifically, teeth 25 present a rounded end, and are defined by an inner surface 27 substantially coplanar with the inner surface of respective wall 21; and by an outer surface 28 sloping inwards of block 2 from the root of the tooth towards its free end. Mating surface 26 presents a section in the form of an upside down V, and consists of an outer portion 29 and an inner portion 30 defining an intermediate edge 31.

From walls 24, respective equally-spaced projections 38—in particular, three for each wall 24—extend integrally outwards for the purpose described in detail later on.

In use, walls 24 of elements 19 are positioned coplanar with respective plate portions 39, 40 (FIG. 1) extending from the opposite axial ends of block 2, and which, together with walls 24, define a flat supporting surface for a seal 41.

Outer casing 3 of the connector is elongated in shape, with a substantially U-shaped cross section with the open side facing terminal board 12 (FIG. 2), and consists of two snap-together parts: a hollow box 45 having a bottom opening 46 facing terminal board 12, and a top opening 47 facing the opposite way; and a cover 48 fitted over opening 47.

Box 45 is defined by two flat, parallel lateral walls 49, a front wall 50, and a rear wall 51.

Externally, front wall 50 presents a hook-shaped elastic element 55 cooperating with a mating element 56 integral with terminal board 12; and rear wall 51 presents an outer tooth 57 engaging a corresponding hole 58 formed in a flexible blade 59 integral with terminal board 12, for snapping and locking casing 3 on to terminal board 12.

On the inner surface, lateral walls 49 present respective longitudinal grooves 60 for receiving projections 38 of elements 19; and lead-in bevels 61 for assisting insertion of the terminal block through opening 47.

Cover 48, with a substantially semi-elliptical cross section, presents a number of lateral connecting elements 63 projecting from respective inner lateral edges of cover 48, and having respective end teeth 64 designed to click inside respective seats 65 formed on the inside of lateral walls 49.

Cover 48 and rear wall 51 integrally define respective half shells 66, 67 in turn defining a through cavity 68 through which to thread the cables out of the connector.

Seal 41 is fitted inside an annular seat 70 defined between the terminal block and box 45, and presents a substantially U-shaped section with the open side facing the supporting surface defined by walls 24 of elements 19 and plate portions 39, 40.

Seal 41 cooperates with an annular mating surface 71 formed on terminal board 12.

Connector 1 is assembled as follows.

Terminals 11 are first inserted inside respective cavities 5, where they are retained by teeth 6; and elements 19 are rotated from the pressed position into the assembly position, in the course of which, teeth 25 contact outer portion 29 of mating surface 26 and are forced over edge 31 against the reaction of elements 18, which first flex and the reaction of which subsequently provides for maintaining elements 19 in a position wherein teeth 25 cooperate with inner portion 30 of surface 26, thus preventing respective element 19 from being released. In this condition, terminals 11 are retained inside respective cavities 5 by the secondary stop defined by teeth 20.

Terminal block 2, complete with respective terminals 11, is then inserted inside box 45 of casing 3 through opening 47. Insertion of block 2, during which projections 38 interfere with lateral walls 49 of box 45, which are deformed elastically, is assisted by bevels 61, and is obviously only possible when both elements 19 are set to the assembly position as described above.

Terminal block 2 is pushed inside box 45 until projections 38 click inside respective grooves 60.

At this point, casing 3 is closed at the top by snapping cover 48 on to box 45.

Fitment of the connector to the terminal board of the electronic control system is effected in known manner, and therefore requires no description.

The advantages of the connector according to the present invention will be clear from the foregoing description. In particular, assembly of terminal block 2 is simplified by requiring no means for retaining elements 19 in the assembly position, which function is performed by teeth 25 engaging respective mating surfaces 26. As such, terminal block 2 may be inserted inside casing 3 through an opening (47) opposite the insertion opening, so that casing 3 may present continuous lateral walls for improved sealing performance.

Terminals 11 may be of any type and, hence, primary retaining teeth 6 and elements 19 of any design; and further sealing means between terminal block 2 and box 45 may be provided on the opposite side of walls 24 and plate portions 39, 40 in relation to seal 41, as well as on the inlet portion of cavities 5, for rendering connector 1 fully airtight.

I claim:

1. An electric connector comprising:

(a) an outer casing;

(b) a terminal block housed inside said casing and having a number of through cavities arranged in at least one row parallel and adjacent to a lateral wall of said terminal block;

(c) a plurality of electric terminals housed inside respective said cavities and retained therein by respective primary retaining means;

(d) secondary means for retaining said terminals (11) inside said cavities, said secondary means comprising at least one movable element integrally connected by hinge means to a lateral wall of said terminal block and having a plurality of first teeth cooperating with respective said terminals in an assembly position wherein said movable element is adjacent to said lateral wall, said movable element comprising at least one outer projection engaging a respective seat formed in a lateral wall of said casing; and (e) means for mutually engaging said lateral wall of said terminal block and said movable element, for maintaining said movable element stably in said assembly position.

2. A connector as claimed in claim 1, wherein said mutual engagement means comprises at least a second tooth integral with said movable element, and a mating surface formed on said lateral wall.

3. A connector as claimed in claim 2, wherein said lateral wall comprises a plurality of through openings communicating with said cavities.

4. A connector as claimed in claim 3, wherein said mutual engagement means comprise a plurality of said second teeth and a corresponding number of mating surfaces formed on at least part of said through openings, on a side of same opposite to said hinge means.

5. A connector as claimed in claim 1, wherein said movable element comprises a first wall hinged integrally along one side to said terminal block and cooperating with said lateral wall in said assembly position, and a second wall extending perpendicularly from an opposite side of said first wall and outwards of said terminal block.

6. A connector as claimed in claim 5, wherein said first wall has a plurality of ribs projecting towards said lateral wall at each said opening in said lateral wall, said first and second teeth originating from said ribs.

7. A connector as claimed in claim 1, wherein said at least one outer projection extends from said second wall.

8. A connector as claimed in claim 1, wherein said terminal block comprises two parallel, side-by-side rows of cavities adjacent to respective lateral walls of said terminal block and a pair of said movable elements hinged to respective said lateral walls.

9. A connector as claimed in claim 1, wherein said casing consists of a box defined by continuous lateral walls and having a top and bottom opening and of a cover designed to fit onto one of said openings.

10. A connector as claimed in claim 9, comprising means for snapping said cover onto said box.

11. A connector as claimed in claim 9, wherein said box comprises lead-in means for inserting said terminal block through said opening in said box prior to fitment of said cover.

* * * * *

UNITED STATES PATENT AND TRADEMARK OFFICE

CERTIFICATE OF CORRECTION

PATENT NO. : 5,403,212

DATED : April 4, 1995

INVENTOR(S) : Mario Aimasso

It is certified that error appears in the above-indentified patent and that said Letters Patent is hereby corrected as shown below:

ON THE TITLE PAGE:

In the heading of the patent, between items [75] and [21], insert --[73] Framatome Connectors International, S.A., Courbevoie, France--

Signed and Sealed this

Seventeenth Day of October, 1995

*Attest:*

*Attesting Officer*

Bruce Lehman

BRUCE LEHMAN

*Commissioner of Patents and Trademarks*